US008783221B2

(12) United States Patent
Woerner et al.

(10) Patent No.: US 8,783,221 B2
(45) Date of Patent: Jul. 22, 2014

(54) LASER-INDUCED SPARK IGNITION FOR AN INTERNAL COMBUSTION ENGINE

(75) Inventors: Pascal Woerner, Stuttgart (DE); Manfred Vogel, Ditzingen (DE); Juergen Raimann, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 378 days.

(21) Appl. No.: 13/129,052

(22) PCT Filed: Nov. 18, 2009

(86) PCT No.: PCT/EP2009/065364
§ 371 (c)(1),
(2), (4) Date: Jul. 12, 2011

(87) PCT Pub. No.: WO2010/057904
PCT Pub. Date: May 27, 2010

(65) Prior Publication Data

US 2011/0259292 A1 Oct. 27, 2011

(30) Foreign Application Priority Data

Nov. 21, 2008 (DE) ..... 10 2008 043 961

(51) Int. Cl.
*F02P 23/04* (2006.01)

(52) U.S. Cl.
USPC ..... 123/143 B

(58) Field of Classification Search
CPC ..... F02P 23/04; F02P 9/007; Y02T 10/125
USPC ..... 123/143 B; 372/103
See application file for complete search history.

(56) References Cited

U.S. PATENT DOCUMENTS

| | | | | |
|---|---|---|---|---|
| 5,619,959 | A * | 4/1997 | Tozzi | 123/143 B |
| 7,305,954 | B2 * | 12/2007 | Hagiwara et al. | 123/143 B |
| 8,607,755 | B2 * | 12/2013 | Weinrotter et al. | 123/143 B |
| 2007/0064746 | A1 * | 3/2007 | Winklhofer et al. | 372/10 |
| 2009/0107436 | A1 | 4/2009 | Schultz | |
| 2009/0159031 | A1 | 6/2009 | Gruber | |
| 2009/0159032 | A1 | 6/2009 | Gruber | |
| 2010/0275867 | A1 | 11/2010 | Weinrotter et al. | |
| 2013/0104827 | A1 * | 5/2013 | Woerner et al. | 123/143 B |
| 2013/0139774 | A1 * | 6/2013 | Woerner et al. | 123/143 B |
| 2013/0152893 | A1 * | 6/2013 | Woerner et al. | 123/143 B |
| 2013/0206091 | A1 * | 8/2013 | Kanehara et al. | 123/143 B |
| 2013/0340696 | A1 * | 12/2013 | Woerner et al. | 123/143 B |

FOREIGN PATENT DOCUMENTS

| | | |
|---|---|---|
| CN | 87 1 03899 | 12/1988 |
| CN | 2615925 | 5/2004 |
| CN | 101184917 | 5/2008 |
| DE | 3913665 | 10/1990 |
| DE | 102006015600 | 10/2007 |
| DE | 102006018973 | 10/2007 |

(Continued)

OTHER PUBLICATIONS

International Search Report, PCT International Patent Application No. PCT/EP2009/065364 dated Mar. 1, 2010.

*Primary Examiner* — Thomas Moulis
*Assistant Examiner* — Elizabeth Hadley
(74) *Attorney, Agent, or Firm* — Kenyon & Kenyon LLP

(57) ABSTRACT

A laser ignition device is provided for an internal combustion engine, having an ignition laser in which a combustion chamber window has an orifice plate arranged in front of it.

10 Claims, 3 Drawing Sheets

(56) References Cited

FOREIGN PATENT DOCUMENTS

| | | | | | |
|---|---|---|---|---|---|
| EP | 1820948 | | 8/2007 | | |
| EP | 2072803 | | 12/2008 | | |
| EP | 2072811 | | 12/2008 | | |
| JP | 55-88074 | | 12/1953 | | |
| JP | 56-59982 | | 10/1954 | | |
| JP | 56-60861 | | 5/1981 | | |
| JP | 63-212772 | | 9/1988 | | |
| JP | 63212772 | A * | 9/1988 | ..... | F02P 23/04 |
| JP | 63212772 | | 9/1998 | | |
| JP | 2006-98404 | | 4/2006 | | |
| JP | 2007-506031 | | 3/2007 | | |
| JP | 2008-2280 | | 1/2008 | | |
| JP | 2008002280 | | 1/2008 | | |
| JP | 2008-45496 | | 2/2008 | | |
| WO | WO 2005/066488 | | 7/2005 | | |
| WO | WO 2009/043608 | | 4/2009 | | |
| WO | WO 2009040177 | | 4/2009 | | |

* cited by examiner

LASER-INDUCED SPARK IGNITION FOR AN INTERNAL COMBUSTION ENGINE

FIELD OF THE INVENTION

The present invention relates to an ignition device for an internal combustion engine, the ignition being triggered by an ignition laser.

BACKGROUND INFORMATION

A laser ignition is described in PCT Application No. WO 2005/066488 A1, for example.

The ignition laser has a combustion chamber window which transmits laser pulses emitted by the ignition laser. At the same time, the combustion chamber window has to withstand the high pressures and temperatures, prevailing in the combustion chamber, over the entire service life of the internal combustion engine, without the optical properties of the combustion chamber window being adversely influenced. At the surface of the combustion chamber window facing the combustion chamber, surface temperatures are able to occur, in this context, of more than 600° C. and pressures of more than 250 bar, during the power cycle of the internal combustion engine. In addition, chemically aggressive components of the exhaust gases are able to damage the combustion chamber window, and deposits on the combustion chamber window are able to reduce its transmissivity.

SUMMARY

An object of the present invention is to provide laser ignition device that is more reliable, more trouble-free and requires less maintenance.

This object may be attained, according to an example embodiment of the present invention, by a laser ignition device for an internal combustion engine, including an ignition laser having a laser-active solid, a combustion chamber window and a housing in that, at the end of the housing at which the combustion chamber window is situated, an orifice plate is provided.

This orifice plate assures that the surface of the combustion chamber window is not touched by the exhaust gases and the gas streams present in the combustion chamber. As a result, the formation of deposits on the combustion chamber window is drastically reduced. These deposits originate with the exhaust gases in the combustion chamber of the internal combustion engine.

Because of the orifice plate according to the present invention, the quantity of the residues depositing on the combustion chamber window is drastically reduced. Also, the impact with which these residues hit the surface of the combustion chamber window is reduced.

The two effects respectively assure that the deposits on the combustion chamber window are reduced and the few deposits adhere less firmly to the combustion chamber window. As a result, the laser ignition device according to the present invention is more reliable, more trouble-free and requires less maintenance.

In a further advantageous embodiment of the present invention, it is provided that the diameter of the orifice plate be dimensioned so that the laser pulse of the ignition laser is able to pass the orifice plate unhindered. To be sure, the diameter of the orifice plate is also not supposed to be greater than absolutely necessary for protecting the combustion chamber window as well as possible. In this context, the diameter of the laser pulse, which may also be designated as the beam diameter, may be ascertained according to the standard DIN EN ISO 11145. This standard is well known to one skilled in the art in the field of laser technology, so that detailed explanations on ascertaining the beam diameter may be skipped by making reference to that standard.

Since the laser pulse of the laser ignition device is focused on an ignition point ZP, and the optical precision of the focusing optic system is very high, it is possible to dimension the orifice plate in such a way that, between the outer contour of the laser pulse and that of the orifice plate a gap of less than 1 mm be present, preferably of less than 0.5 mm, and especially preferably of less than 0.25 mm.

The smaller the diameter of the orifice plate, the less gas flows into the orifice plate, and the less gas is thus able to reach the combustion chamber window.

One additional advantageous embodiment of the present invention provides that the orifice plate is conical, the diameter of the orifice plate increasing in the direct towards the combustion chamber window, and the cone angle of the orifice plate is generally equivalent to the angle of exit of the laser pulse. In this case, too, it is possible for the orifice plate to be situated around the laser pulse over the entire length at a distance of less than 1 mm, preferably less than 0.5 mm, and especially preferably of less than 0.25 mm. Because of the length of the orifice plate in the direction of the optical axis of the ignition laser, the penetration of exhaust gases and the depositing of contamination on the combustion chamber window are further reduced. At the same time, the dead volume of the orifice plate is reduced, which has an advantageous effect on the operating response of the internal combustion engine.

One advantageous embodiment of the laser ignition device according to the present invention provides that the orifice plate be developed as a separate component, and be fastened on the housing of the ignition laser, particularly on a shoulder of the housing.

Because of that, it is possible to retrofit even laser ignition devices that are already in production, with the orifice plate according to the present invention. Furthermore, it is possible to adapt the diameter of the orifice plate and the cone angle of the orifice plate to the optical properties of the ignition laser, by exchanging the separate components. It may thus be necessary, for instance, when using an ignition laser in combustion chambers having different combustion chamber geographies, to position ignition point ZP of the ignition laser to be at a greater or lesser distance from the combustion chamber window. Such a change of the ignition point generally requires adapting the diameter and the cone angle of the orifice plate. This may be done with ease using an orifice plate executed as a separate component.

In an additional advantageous embodiment of the present invention, it is also possible to develop the orifice plate in one piece with the housing of the ignition laser.

If the ignition point laser has a combustion chamber window, this is acted upon only by comparatively low temperatures and by a lower quantity of exhaust gases, because of the use of the orifice plate according to the present invention.

Because of this, the transmissivity of the combustion chamber window remains sufficiently high over the entire service life of the internal combustion engine, so as to assure the undisturbed operation of the internal combustion engine.

In one additional advantageous embodiment of the laser ignition device according to the present invention, the orifice plate screens the ignition laser only from area to area, namely over a circumferential angle of less than 360°. In this context, in the inserted state of the ignition laser, the orifice plate is situated upstream of the ignition laser with reference to the main flow direction of the exhaust gases in the combustion chamber. If the orifice plate is positioned in this way relative to the ignition laser, the desired screening is achieved.

The main flow direction of the exhaust gases in the combustion chamber should be ascertained separately for each type of engine. In order to position the orifice plate correctly with respect to the ignition laser, the ignition laser may be fastened in the cylinder head of the internal combustion engine, using form locking, and in a torsion-proof manner. By using a projection, mounted on the ignition laser, which cooperates with a correspondingly formed recess in the cylinder head, one may assure that the orifice plate is positioned in the manner described above, relative to the ignition laser.

It may be particularly suitable if the orifice plate screens the ignition laser over a circumferential angle of less than 200°, preferably of 160° to 180°. This ensures sufficient screening for many applications, at minimal cost and minimal influencing of the gas flow in the combustion chamber.

Additional advantages and advantageous developments of the present invention may be found in the figures, and the description below. All the features shown in the figures and their descriptions are part of the present invention, both individually and in any combination with one another.

DETAILED DESCRIPTION OF EXAMPLE EMBODIMENTS

Figure 1A:
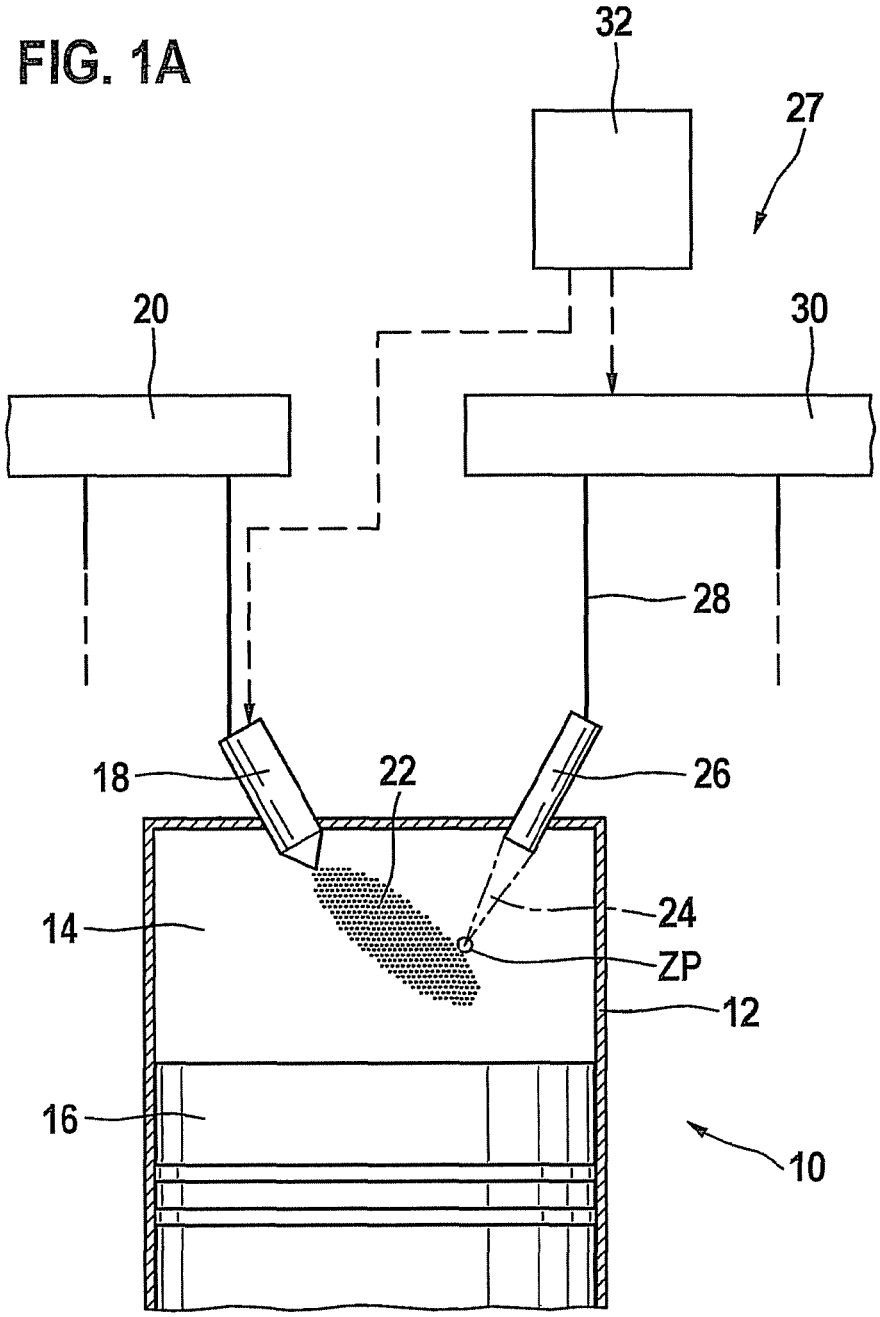
FIG. 1*a* shows a schematic representation of an internal combustion engine having a laser-based ignition device.

In FIG. 1*a*, the entire internal combustion engine is denoted by reference numeral 10. It may be used for driving a motor vehicle. Internal combustion engine 10 includes multiple cylinders, only one of which is designated in FIG. 1 by reference numeral 12. A combustion chamber 14 of cylinder 12 is bounded by a piston 16. Fuel reaches combustion chamber 14 directly through an injector 18, which is connected to a fuel pressure reservoir 20 that is also designated as a rail.

Fuel 22 injected into combustion chamber 14 is ignited by a laser pulse 24, which is eradiated into combustion chamber 14 by an ignition device 27 that includes an ignition laser 26. For this purpose, a light guide device 28 feeds ignition laser 26 with a pumping light provided by a pumping light source 30. Pumping light source 30 is controlled by a control unit 32, which also controls injector 18.

Figure 1B:
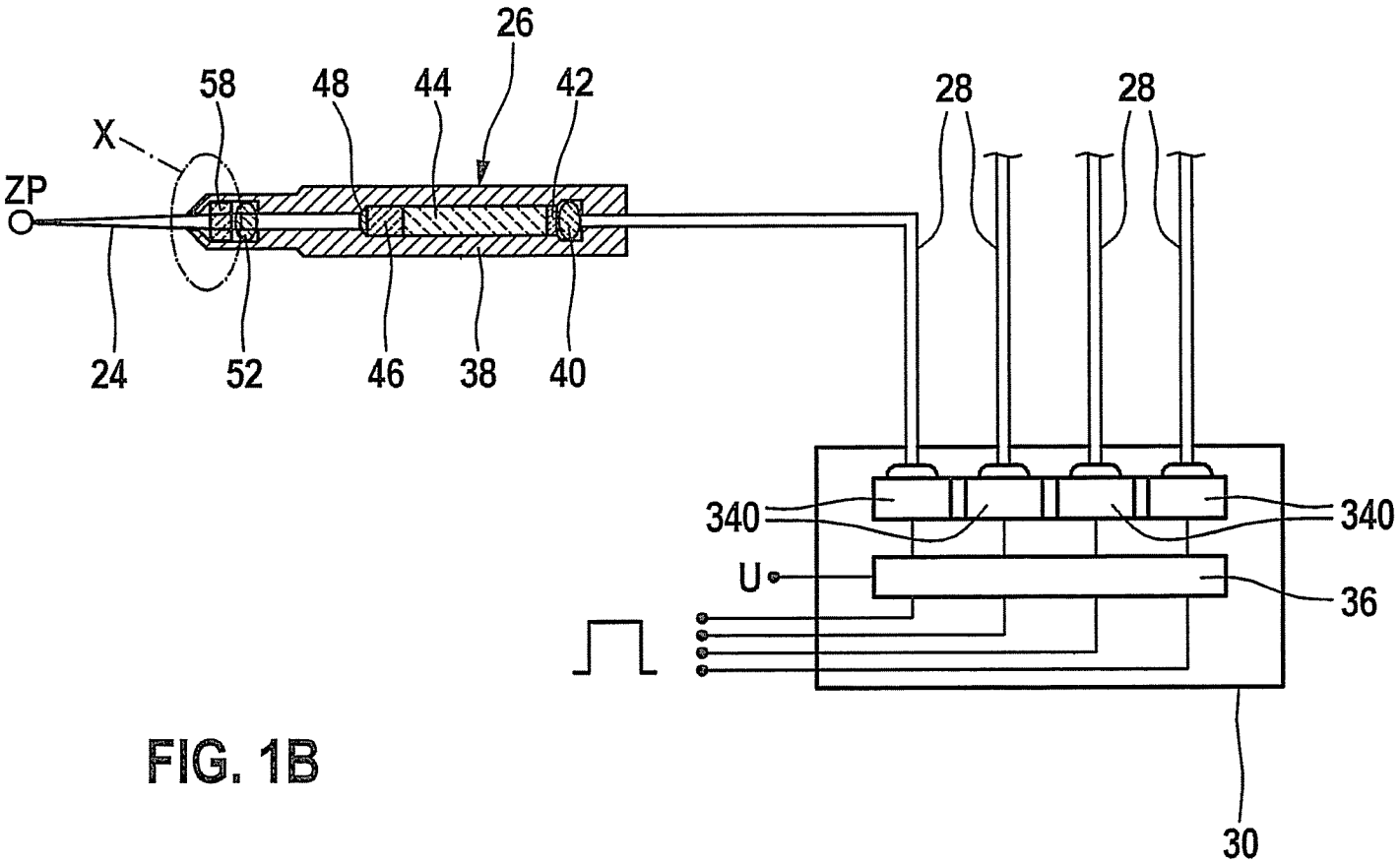
FIG. 1*b* shows a schematic representation of the ignition device in FIG. 1.

As may be gathered from FIG. 1*b*, pumping light source 30 feeds multiple light guide devices 28 for different ignition lasers 26, which are respectively associated with one cylinder 12 of internal combustion engine 10. Toward this end, pumping light source 30 has multiple individual laser light sources 340, which are connected to a pulsed current supply 36. Because of the presence of the plurality of individual laser light sources 340, a quasi "latent" distribution of pumping light to the various ignition lasers 26 is implemented, so that no optical distributors or the like are required between pumping light source 30 and ignition lasers 26.

Ignition laser 26 has, for example, a laser-active solid 44 having a passive Q-switch 46, which, in conjunction with a coupling mirror 42 and a decoupling mirror 48 forms an optical resonator. When supplied with pumping light generated by pumping light source 30, ignition laser 26 generates a laser pulse 24 in a conventional manner, which is focused by focusing optics 52 on an ignition point ZP situated in combustion chamber 14 (FIG. 1*a*). The components located in housing 38 of ignition laser 26 are separated from combustion chamber 14 by a combustion chamber window 58.

Figure 2:
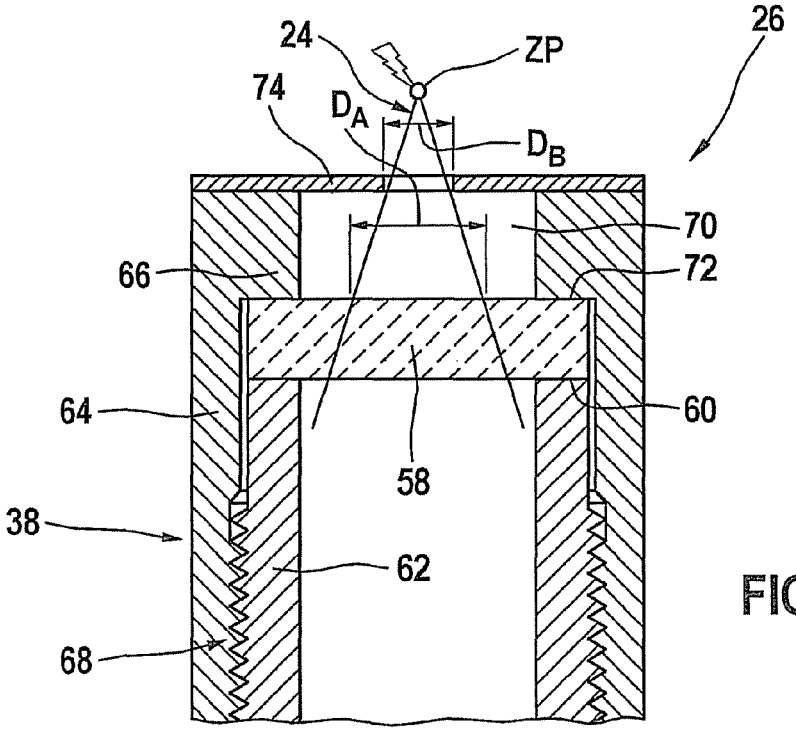
FIGS. 2 and 3 show specific embodiments of ignition lasers according to the present invention.

FIG. 2 shows detail X from FIG. 1*b* in a partial longitudinal section, considerably enlarged. From this greatly enlarged representation it becomes clear that combustion chamber window 58 is connected in a sealing manner to housing 38. The seal between housing 38 and the combustion chamber window may be developed, in the area of reference numeral 60, in the form of a continuous material connection or a force-locking connection.

Because of the high thermal stresses, one should be careful that housing 38 is made of a heat-resistant material, and as a result, also has a sufficient fatigue resistance at the operating temperatures prevailing in the combustion chamber.

Figure 3:
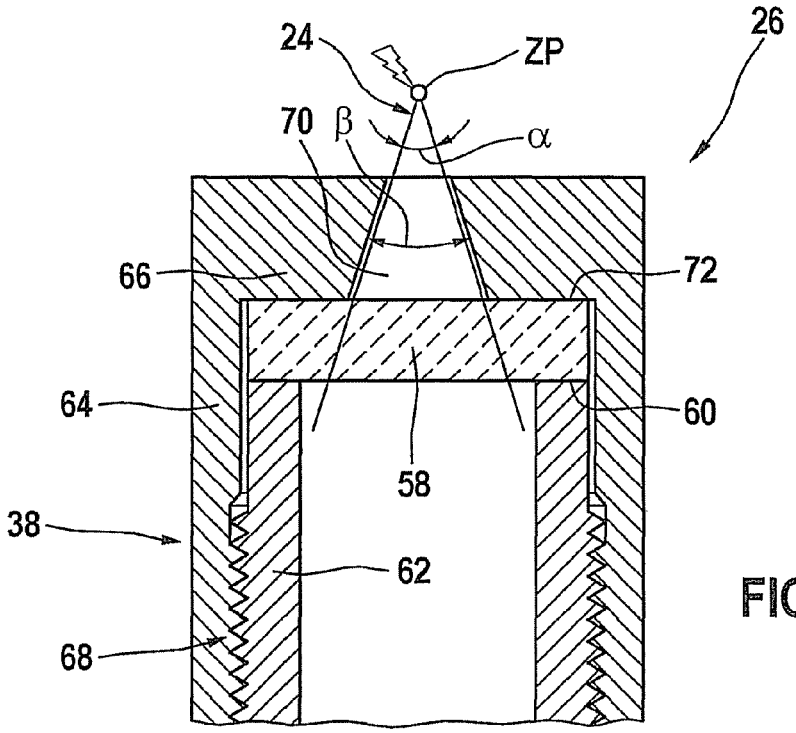

In the exemplary embodiments shown in FIGS. 2 and 3, housing 38 is developed in two parts. It includes an inner sleeve 62 and an outer sleeve 64. Outer sleeve 64 has a shoulder 66 at one end facing combustion chamber 14 (see FIG. 1*a*). Shoulder 66 is used to press combustion chamber window 58 against inner sleeve 62, and thereby to increase the sealing in the area of reference numeral 60. For this purpose, a female thread is provided on outer sleeve 64, which collaborates with a corresponding male thread of inner sleeve 62. This threaded arrangement, made up of a female thread and a male thread, is designated in its entirety by reference numeral 68. Because of the bracing of outer sleeve 64 and inner sleeve 62, an additional sealing surface is created between shoulder 66 and the combustion chamber window.

FIG. 2 shows the end facing combustion chamber 14 of ignition laser 26, clearly enlarged. On the inside of housing 38, a focusing optical system is located, that is not shown, which focuses laser pulse 24 on ignition point ZP, which corresponds to the focal point of the optical system of ignition laser 26. The outer contour of focused laser pulse 24 is indicated by the conical envelope lines (not having reference numerals). These envelope lines intersect at ignition point ZP, and exit at a diameter $D_A$ from combustion chamber window 58.

In order for the side of combustion chamber window 58, that faces the combustion chamber, to be exposed as little as possible to the exhaust gases, it is provided, according to the present invention, that an orifice plate 74 be positioned between combustion chamber window 58 and ignition point ZP. The diameter of the orifice plate is characterized by reference numeral $D_B$.

Diameter $D_B$ of orifice plate 74 is selected to be as small as possible. As a result, it is sufficient if orifice plate 74 has a radial distance from laser pulse 24, or rather its outer contour, of less than 1 mm, preferably of less than 0.5 mm and especially preferably of less than 0.25 mm. This dimensioning of diameter $D_B$ of orifice plate 74 results in the ignition performance of laser pulse 24 not being reduced, and, on the other hand, that the gas exchange between the combustion chamber and "dead space" 70 present between orifice plate 74 and combustion chamber window 58 is minimized. Orifice plate 74, for instance, in the form of a sheet metal disk, may be soldered or welded or fastened in another way onto outer sleeve 64.

The less exhaust gases arrive from the combustion chamber at dead space 70, the fewer the deposits that deposit on combustion chamber window 58. It may be advantageous to move orifice plate 74 as close as possible in the direction of ignition point ZP. It is true that this also has a limit, since ignition point ZP is supposed to be situated as nearly as possible in the middle of combustion chamber 14, and orifice plate 74 is supposed to impair the flow conditions in combustion chamber 14 (see FIG. 1*a*) as little as possible.

FIG. 3 shows a further exemplary embodiment of an orifice plate 74 according to the present invention. The differences may be seen in that orifice plate 74 is a part of outer sleeve 64, and orifice plate 74 is developed conically. Cone angle β of orifice plate 74 corresponds to angle α of laser pulse 24, in this context. Here too, one should be careful that the radial distance between orifice plate 74 and ignition pulse 24 is as small as possible. Because dead space 70 has been diminished even further, in this exemplary embodiment, compared to the exemplary embodiment shown in FIG. 2, again, fewer deposits are deposited on combustion chamber window 58.

What is claimed is:

1. A laser ignition device for an internal combustion engine, comprising:

an ignition laser having a laser-active solid, a combustion chamber window having a surface, and a housing, the combustion window being situated at an end of the housing and connected in a sealing manner;

wherein an orifice plate is situated at an outer end of the housing at which the combustion chamber window is situated inside the housing, creating a dead space between the orifice plate and the combustion chamber window;

wherein the orifice plate has a conical opening, the diameter of the conical opening of the orifice plate increasing in a direction of the combustion chamber window, and a cone angle of the orifice plate corresponds to an exit angle of the laser pulse.

2. The laser ignition device as recited in claim 1 wherein a diameter of the orifice plate is dimensioned so that a laser pulse of the ignition laser is able to pass the orifice plate unhindered.

3. The laser ignition device as recited in claim 1, wherein the orifice plate is a separate component, and is fastened to a shoulder of the housing.

4. The laser ignition device as recited in claim 1, wherein the orifice plate is one piece with the housing.

5. The laser ignition device as recited in claim 4, wherein the orifice plate is one piece with a shoulder of the housing.

6. The laser ignition device as recited in claim 1, wherein the housing includes an inner sleeve and an outer sleeve.

7. The laser ignition device as recited in claim 1, wherein, in an inserted state of the ignition laser, the orifice plate closes flush with a combustion chamber wall of the internal combustion engine.

8. The laser ignition device as recited in claim 1, wherein the orifice plate screens the ignition laser only partially, and, in an inserted state of the ignition laser, the orifice plate is situated upstream of the ignition laser with reference to a main flow direction of exhaust gases in the combustion chamber.

9. The laser ignition device as recited in claim 1, wherein the orifice plate screens the ignition laser over a circumferential angle of a maximum of 200°.

10. The laser ignition device as recited in claim 9, wherein the orifice plate screens the ignition laser over a circumferential angle of 160° to 180°.

* * * * *